United States Patent [19]

Lulloff

[11] Patent Number: 4,995,233

[45] Date of Patent: Feb. 26, 1991

[54] AUTOMATICALLY CONTROLLED EXHAUST ASSEMBLY FOR MARINE STERN DRIVE

[75] Inventor: Ricky H. Lulloff, Neenah, Wis.

[73] Assignee: Brunswick Corporation, Skokie, Ill.

[21] Appl. No.: 476,352

[22] Filed: Feb. 7, 1990

[51] Int. Cl.[5] ..... B63H 21/32

[52] U.S. Cl. ..... 60/324; 440/89

[58] Field of Search ..... 60/324; 440/89

[56] References Cited

U.S. PATENT DOCUMENTS 4,178,873 12/1979 Bankstahl .
4,504,238 3/1985 Neisen .
4,573,318 3/1986 Entringer et al. .
4,773,215 9/1988 Winberg et al. .

*Primary Examiner*—Douglas Hart

*Attorney, Agent, or Firm*—Andrus, Sceales, Starke & Sawall

[57] ABSTRACT

A stern drive marine propulsion system (2) has an inboard engine (4) with an exhaust (6), an outboard drive unit (8) and propeller (14) operatively coupled to the engine and separated therefrom by a transom (10) having two exhaust passages (28 and 34) therethrough, and an exhaust control assembly (16) having an inlet (18) connected to the engine exhaust, first and second outlets (22 and 24) communicating with respective exhaust passages extending aft through the transom, and a valve (26) in the assembly having a first condition (26*a*) providing communication of the inlet with the first outlet, and a second condition (26*b*) blocking communication of the inlet with the first outlet. Automatic control circuitry automatically controls actuation of the valve between the first and second conditions in response to a given parameter.

14 Claims, 2 Drawing Sheets

AUTOMATICALLY CONTROLLED EXHAUST ASSEMBLY FOR MARINE STERN DRIVE

BACKGROUND AND SUMMARY

The invention relates to an exhaust system for a stern drive marine propulsion system.

The invention arose during continuing development efforts relating to the exhaust system in Winberg et al U.S. Pat. No. 4,773,215, assigned to the assignee of the present invention, and incorporated herein by reference.

The transom of the boat has two exhaust passages therethrough. The exhaust control assembly has a valve which is automatically controlled to control engine exhaust between different outlets in response to a given parameter.

DETAILED DESCRIPTION

Figure 1:
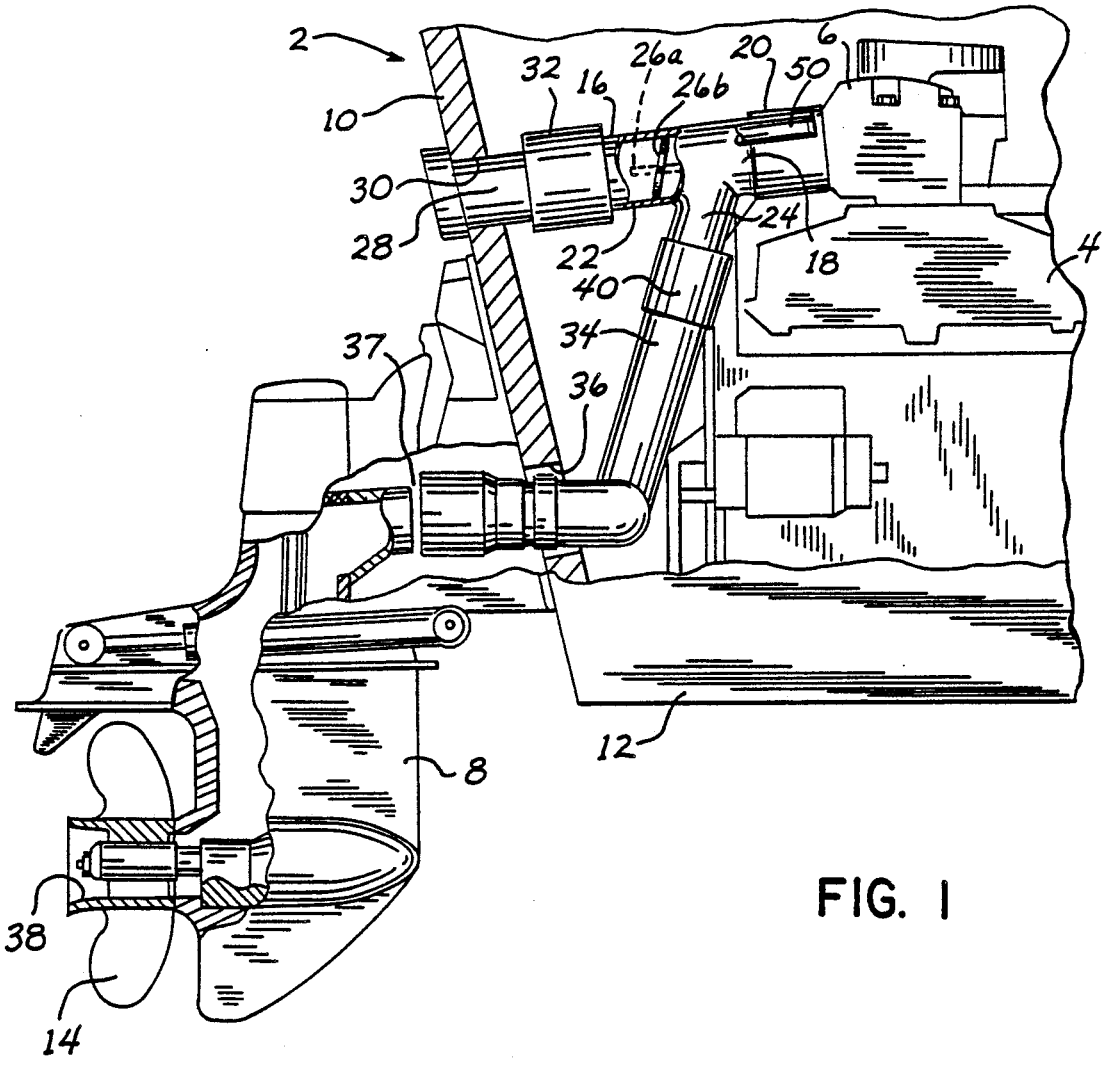
FIG. 1 is a view of a stern drive marine propulsion system with an exhaust assembly.

FIG. 1 shows a stern drive marine propulsion system 2 like that in FIG. 1 of incorporated U.S. Pat. No. 4,773,215, and uses like reference numerals where appropriate to facilitate understanding. Stern drive marine propulsion system 2 has an inboard engine 4 with an exhaust at exhaust elbow 6, and has an outboard drive unit 8 operatively coupled to the engine and separated therefrom by transom 10 of boat 12. Engine 4 is drivingly connected to propeller 14 for propelling boat 12. Exhaust elbow 6 is shown and described in U.S. Pat. No. 4,573,318, incorporated herein by reference.

Exhaust control assembly 16 is aft of engine exhaust elbow 6 and forward of transom 10. Assembly 16 has an inlet 18 connected to exhaust elbow 6 by a tubular rubber or the like sleeve 20 fitting snuggly around inlet 18 and the outlet of exhaust elbow 6. Assembly 16 has first and second outlets 22 and 24. Valve 26 selectively controls communication of inlet 18 with outlet 22. Outlet 22 is connected to exhaust passage pipe 28 extending aft through a first aperture 30 in transom 10. One of the pipes could go through a muffler before going through the transom. Outlet 22 is connected to pipe 28 by tubular rubber or the like sleeve 32 fitting snuggly therearound. Outlet 24 is connected to exhaust passage pipe 34 extending aft through a second aperture 36 in transom 10 and connected to the outdrive at slip joint 37, as shown in U.S. Pat. No. 4,178,873, incorporated herein by reference. As an alternative to slip joint 37, a bellows connection may be used. The exhaust passage extends through outboard drive unit 8 and propeller 14 as shown at discharge passage 38. Outlet 24 is connected to exhaust passage pipe 34 by tubular rubber or the like sleeve 40 fitting snuggly therearound.

Figure 2:
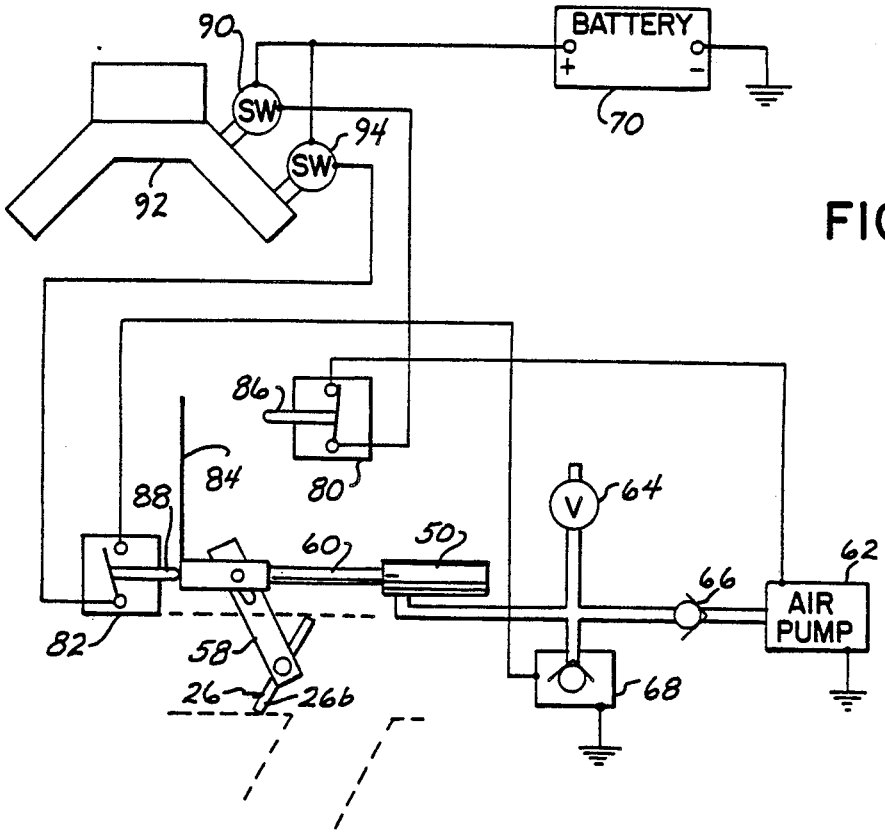
FIG. 2 is a schematic circuit diagram of automatic control circuitry in accordance with the invention.
Figure 3:
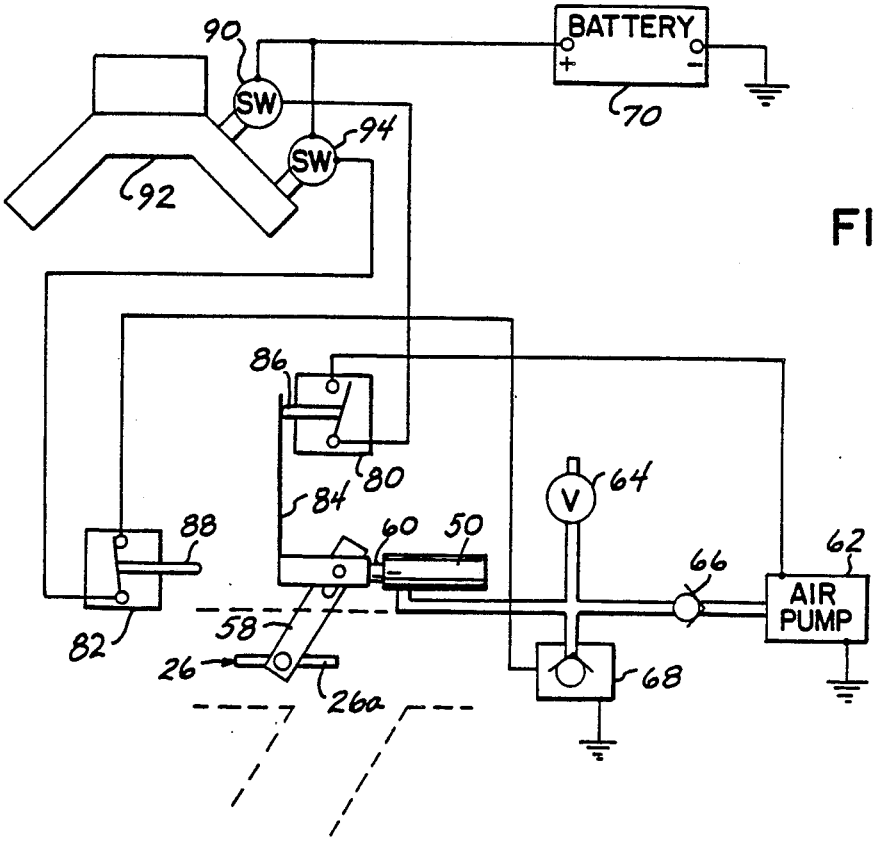
FIG. 3 is like FIG. 2 and shows another operating condition of the control circuitry.

Valve 26 is in outlet 22 and has a first condition as shown at 26*a* providing communicating of inlet 18 with outlet 22, and has a second condition as shown at 26*b* blocking communication of inlet 18 with outlet 22. These conditions are also shown in FIGS. 2–4 of incorporated U.S. Pat. No. 4,773,215. Inlet 18 and outlet 22 form a straight-through passage. As described in incorporated U.S. Pat. No. 4,773,215, valve 26 is a butterfly valve at the entrance to outlet 22, and is provided by a plate-like disc mounted on a rotary shaft extending through the interior of the assembly and pivotally mounted to the sidewalls thereof. In the open position 26*a*, the disc of the butterfly valve is parallel to the straight-through passage and provides communication of inlet 18 with outlet 22. In the closed position 26*b*, the disc of the butterfly valve is substantially parallel to the passage through outlet 24 and provides the bend in the bent passage and deflects exhaust from inlet 18 to outlet 24. A pneumatic actuator is provided by an air cylinder 50 having an extensible and retractible piston 60, FIGS. 2 and 3, connected to linkage 58, for pivoting valve 26 to operate same between open condition 26*a* and closed condition 26*b*, all as in incorporated U.S. Pat. No. 4,773,215.

FIGS. 2 and 3 show automatic control circuitry for automatically controlling actuation of valve 26 between its open condition 26*a* and its closed condition 26*b*. A portion of the circuitry is like that shown in FIG. 5 of incorporated U.S. Pat. No. 4,773,215. Air cylinder 50 is a Parker fluid power part number 1.06RSRYO2.0EV. Air cylinder 50 is internally spring biased such that piston 60 is normally extended leftwardly, and hence butterfly valve 26 is normally in the closed position 26*b* as shown in FIG. 2. An air pump 62 is provided for supplying pressurized air to air cylinder 50. Air pump 62 is a Thomas Industries compressor part number 405ADC38/12. A regulator valve 64 is provided for regulating the pressure supplied by air pump 62 to air cylinder 50, to prevent overpressuring and damaging the system. Regulator valve 64 is a Circle Seal Controls relief valve part number 532IM30. A one-way check valve 66 is provided between air pump 62 and air cylinder 50 blocking back-pressure from air cylinder 50 to air pump 62, to prevent the system from leaking and changing the valve position. Check valve 66 is a Circle Seal Controls check valve part number 2232B-IMM. A relief valve 68 is provided for affirmatively depressurizing the air cylinder and changing valve position. Relief valve 68 is a Skinner electric solenoid valve catalog number B2DA1175. A voltage source is provided by boat battery 70. The type of system in which the present invention and that in incorporated U.S. Pat. No. 4,773,215 is typically used is shown in U.S. Pat. No. 4,504,238, incorporated herein by reference.

Air cylinder 50 provides an actuator with a piston 60 having a first rightward travel stroke actuating valve 26 to its open condition 26*a*, FIG. 3, and having a second leftward travel stroke actuating valve 26 to its closed condition 26*b*, FIG. 2. A first normally closed electric switch 80, provided by a Honeywell microswitch part number BZ2RW84-A2, is electrically connected to air pump 62. A second normally closed electric switch 82, also provided by a Honeywell microswitch part number BZ2RW84-A2, is electrically connected to relief valve 68. During the rightward travel stroke of piston 60 to the position shown in FIG. 3, tab 84 on piston 60 engages and rightwardly depresses plunger 86 of switch 80 to actuate the latter to an open state. Also during this rightward travel stroke, piston 60 moves rightwardly away from and disengages plunger 88 of switch 82, allowing plunger 88 to extend rightwardly, to return switch 82 to its normally closed state, FIG. 3. During the leftward travel stroke of piston 60, tab 84 moves leftwardly away from and disengaging plunger 86 of switch 80, allowing plunger 86 to extend leftwardly such that switch 80 resumes its normally closed state, FIG. 2. Also during this leftward movement, piston 60 engages and depresses plunger 88 leftwardly to actuate switch 82 to an open state, FIG. 2.

A third electric switch 90, provided by a Whitman Controls Corporation part number P117 pressure switch, is electrically connected between voltage source 70 and electric switch 80 and completes an electric circuit between voltage source 70 and electric switch 80 in response to a given parameter, namely high engine manifold pressure in engine manifold 92, though other parameters may be chosen. A fourth electric switch 94, provided by a Whitman Controls Corporation part number P100 low pressure switch, is electrically connected between voltage source 70 and switch 82 and completes an electric circuit between voltage source 70 and switch 82 in response to a second given parameter, namely low engine manifold pressure, though other parameters may be chosen. High engine intake manifold pressure is indicative of high engine power requirements such as high engine speed, full throttle, hard acceleration, etc. Low engine intake manifold pressure is indicative of low engine power requirements, for example at cruising speed and at idle.

In operation, in response to high pressure in engine intake manifold 92, switch 90 is activated to a closed state, and electrical current is conducted from voltage source 70 through switch 90 and through switch 80 to air pump 62 to supply pressurized air to air cylinder 50 to initiate the rightward travel stroke of piston 60. This rightward travel stroke of piston 60 actuates switch 80 to its open state, FIG. 3, to electrically disconnect air pump 62 from voltage source 70. This rightward travel stroke of piston 60 also actuates switch 82 to its closed state, FIG. 3.

In response to low pressure in intake manifold 92, switch 94 is activated to its closed state, and electrical current is conducted from voltage source 70 through switch 94 and through switch 82 to relief valve 68 to actuate the latter to relieve air pressure from air cylinder 50 to initiate the leftward travel stroke of piston 60 which moves leftwardly to its normally leftwardly biased extended position. The leftward travel stroke of piston 60 actuates switch 82 to its open state, FIG. 2, to disconnect relief valve 68 from voltage source 70. The leftward travel stroke of piston 60 also actuates switch 80 to its closed state, FIG. 2.

Voltage source 70, switch 90, switch 80, and air pump 62 are all connected in series in a first electric circuit, such that either of switches 80 and 90 may disconnect air pump 62 from voltage source 70. Voltage source 70, switch 94, switch 82, and relief valve 68 are all connected electrically in series in a second electric circuit, such that either of switches 82 and 94 may disconnect relief valve 68 from voltage source 70.

Electric switch 80 is in its closed state at the end of the leftward travel stroke of piston 60, FIG. 2, such that the system is ready and responsive to high pressure in manifold 92 activating switch 90 to a closed state, completing an electric circuit from voltage source 70 through switch 90 and through switch 80 to air pump 62 to initiate the rightward travel stroke of piston 60 to actuate valve 26 to its open condition 26*a*, FIG. 3. Switch 82 is in its closed state at the end of the rightward travel stroke of piston 60, FIG. 3, such that the system is ready and responsive to low pressure in manifold 92 activating switch 94 to a closed state completing an electric circuit from voltage source 70 through switch 94 and through switch 82 to relief valve 68 to initiate the leftward travel stroke of piston 60 to actuate valve 26 to its closed condition 26*b*, FIG. 2. Electric switches 80 and 82 are in opposite states of conduction at the ends of the travel stroke of piston 60, such that switch 80 is closed when switch 82 is open, FIG. 2, and switch 80 is open when switch 82 is closed, FIG. 3. In the middle of the travel stroke of piston 60, both switches 80 and 82 are closed.

It is recognized that various equivalents, alternatives and modifications are possible within the scope of the appended claims.

I claim:

1. A stern drive marine propulsion system for a boat having a transom, comprising:

an inboard engine with an exhaust;

an outboard drive unit and propeller operatively coupled to said engine and separated therefrom by said transom;

an exhaust control assembly aft of said engine exhaust and forward of said transom, said assembly having an inlet connected to said engine exhaust, and having first and second outlets, and a valve in said assembly having a first condition providing communication of said inlet with said first outlet, and a second condition blocking communication of said inlet with said first outlet;

first passage means connected to said first outlet and extending aft through said transom;

second passage means connected to said second outlet and extending aft through said transom;

automatic control circuitry for automatically controlling actuation of said valve between said first and second conditions in response to a given parameter.

2. The invention according to claim 1 wherein said second passage extends aft through said transom and through said outboard drive unit and discharges at said propeller, and said automatic control circuitry responds to engine power requirements and automatically actuates said valve to said first condition at high power requirements, and automatically actuates said valve to said second condition at low power requirements.

3. The invention according to claim 2 wherein said automatic control circuitry actuates said valve to said first condition at high engine speed, and actuates said valve to said second condition at low engine speed.

4. The invention according to claim 3 wherein said automatic control circuitry actuates said valve to said first condition at full throttle and at hard acceleration conditions of said engine, and actuates said valve to said second condition at cruising speed and at idle conditions of said engine.

5. The invention according to claim 4 wherein said engine includes an intake manifold, and wherein said automatic control circuitry includes pressure switch means responsive to engine intake manifold pressure such that said automatic control circuitry responds to high engine intake manifold pressure indicative of said full throttle and said hard acceleration conditions and actuates said valve to said first condition, and responds to low engine intake manifold pressure indicative of said cruising speed and idle conditions and actuates said valve to said second condition.

6. A stern drive marine propulsion system for a boat having a transom, comprising:

an inboard engine with an exhaust;

an outboard drive unit and propeller operatively coupled to said engine and separated therefrom by said transom;

an exhaust control assembly having an inlet connected to said engine exhaust, and having first and second outlets, and a valve in said assembly having a first condition providing communication of said inlet with said first outlet, and a second condition blocking communication of said inlet with said first outlet;

automatic control circuitry comprising:

a voltage source;

actuator means having a first travel stroke actuating said valve to said first condition, and having a second travel stroke actuating said valve to said second condition;

first electrically controlled means operatively coupled to said actuator means and electrically actuatable to initiate said first travel stroke;

second electrically controlled means operatively coupled to said actuator means and electrically actuatable to initiate said second travel stroke;

a first electric switch electrically connected to said first electrically controlled means and actuated by said actuator means during said first travel stroke to an open state, and actuated by said actuator means during said second travel stroke to a closed state;

a second electric switch electrically connected to said second electrically controlled means and actuated by said actuator means during said first travel stroke to a closed state, and actuated by said actuator means during said second travel stroke to an open state;

a third electric switch electrically connected between said voltage source and said first electric switch and completing an electric circuit between said voltage source and said first electric switch in response to a given parameter;

a fourth electric switch electrically connected between said voltage source and said second electric switch and completing an electric circuit between said voltage source and said second electric switch in response to a second given parameter;

such that in response to said first given parameter, electrical current is conducted from said voltage source through said third electric switch and through said first electric switch to said first electrically controlled means to initiate said first travel stroke of said actuator means, said first travel stroke actuating said first electric switch to said open state to electrically disconnect said first electrically controlled means from said voltage source, said first travel stroke also actuating said second electric switch to said closed state;

and such that in response to said second given parameter, electrical current is conducted from said voltage source through said fourth electric switch and through said second electric switch to said second electrically controlled means to initiate said second travel stroke, said second travel stroke of said actuator means actuating said second electric switch to said open state to disconnect said second electrically controlled means from said voltage source, said second travel stroke of said actuator means also actuating said first electric switch to said closed state.

7. The invention according to claim 6 wherein said first and second electrically controlled means are each pneumatically coupled to said actuator means.

8. The invention according to claim 7 wherein one of said first and second electrically controlled means comprises an air pressure source, and the other of said first and second electrically controlled means comprises a pressure relief valve.

9. The invention according to claim 6 comprising a first electrical circuit comprising said voltage source, said third electric switch, said first electric switch, and said first electrically controlled means all connected electrically in series, and a second electrical circuit comprising said voltage source, said fourth electric switch, said second electric switch, and said second electrically controlled means all connected electrically in series, such that either of said first and third electric switches may disconnect said first electrically controlled means from said voltage source, and such that either of said second and fourth electric switches may disconnect said second electrically controlled means from said voltage source.

10. The invention according to claim 9 wherein said first electric switch is in said closed state at the end of said second travel stroke such that said system is ready and responsive to said first given parameter activating said third electric switch to a closed state completing an electric circuit from said voltage source through said third electric switch and through said first electric switch to said first electrically controlled means to initiate said first travel stroke of said actuator means to said first condition, and wherein said second electric switch is in said closed state at the end of said first travel stroke such that said system is ready and responsive to said second given parameter activating said fourth electric switch to a closed state completing an electric circuit from said voltage source through said fourth electric switch and through said second electric switch to said second electrically controlled means to initiate said second travel stroke of said actuator means to said second condition.

11. A stern drive marine propulsion system for a boat having a transom, comprising:

an inboard engine with an exhaust;

an outboard drive unit and propeller operatively coupled to said engine and separated therefrom by said transom;

an exhaust control assembly having an inlet connected to said engine exhaust, and having first and second outlets, and a valve in said assembly having a first condition providing communication of said inlet with said first outlet, and a second condition blocking communication of said inlet with said first outlet;

control circuitry for said valve comprising:

an air cylinder operatively coupled to said valve for selectively controlling actuation of said valve between said first and second conditions;

an air pump for supplying pressurized air to said air cylinder;

a regulator valve for regulating the pressure supplied by said air pump to said air cylinder;

a check valve between said air pump and said air cylinder blocking back-pressure from said air cylinder to said air pump;

a relief valve for affirmatively depressurizing said air cylinder and changing the valve condition;

a voltage source;

a first electric switch electrically connected to said air pump;

a second electric switch electrically connected to said relief valve;

a third electric switch electrically connected between said voltage source and said first electric switch;

a fourth electric switch electrically connected between said voltage source and said second electric switch;

said third electric switch being responsive to a first given parameter to complete an electric circuit from said voltage source through said third electric switch and through said first electric switch to said air pump to actuate the latter to supply pressurized air to said air cylinder;

said fourth electric switch being responsive to a second given parameter for completing an electric circuit from said voltage source through said fourth electric switch and through said second electric switch to said relief valve to actuate the latter to depressurize said air cylinder.

12. The invention according to claim 11 wherein said air cylinder has a piston with a travel stroke and actuates said valve to said first condition at one end of said travel stroke and actuates said valve to said second condition at the other end of said travel stroke, and wherein said first and second electric switches are in opposite states of conduction at the ends of said travel stroke, such that said first electric switch is closed when said second electric switch is open, and said first electric switch is open when said second electric switch is closed.

13. The invention according to claim 12 wherein both of said electric switches are in the same state of conduction in the middle of said travel stroke.

14. The invention according to claim 13 wherein both of said electric switches are closed in the middle of said travel stroke.

* * * * *